US010136478B2

(12) United States Patent
Anton Falcon et al.

(10) Patent No.: US 10,136,478 B2
(45) Date of Patent: Nov. 20, 2018

(54) HOB DEVICE

(75) Inventors: Daniel Anton Falcon, Zaragoza (ES); Jose Ignacio Artigas Maestre, Zaragoza (ES); Luis Angel Barragan Perez, Zaragoza (ES); Carlos Bernal Ruiz, La Puebla de Alfinden (ES); José Miguel Burdio Pinilla, Zaragoza (ES); Claudio Carretero Chamarro, Zaragoza (ES); Jose Maria De la Cuerda Ortin, Zaragoza (ES); Jose-Ramon Garcia Jimenez, Dillingen (DE); Pablo Jesus Hernandez Blasco, Cuarte de Huerva (ES); Oscar Jimenez Navascues, Cintruénigo (ES); Sergio Llorente Gil, Zaragoza (ES); Oscar Lucia Gil, Zaragoza (ES); Arturo Mediano Heredia, Zaragoza (ES); Ignacio Millan Serrano, Zaragoza (ES); Fernando Monterde Aznar, Zaragoza (ES); Daniel Moros Sanz, Zaragoza (ES); Denis Navarro Tabernero, Zuera (ES); Jose Joaquin Paricio Azcona, Zaragoza (ES); Diego Puyal Puente, Zaragoza (ES); Isidro Urriza Parroque, Zaragoza (ES)

(73) Assignee: BSH Hausgeräte GmbH, Munich (DE)

( * ) Notice: Subject to any disclaimer, the term of this patent is extended or adjusted under 35 U.S.C. 154(b) by 1121 days.

(21) Appl. No.: 13/643,128

(22) PCT Filed: Apr. 1, 2011

(86) PCT No.: PCT/IB2011/051396

§ 371 (c)(1),
(2), (4) Date: Oct. 24, 2012

(87) PCT Pub. No.: WO2011/135470

PCT Pub. Date: Nov. 3, 2011

(65) Prior Publication Data

US 2013/0043239 A1 Feb. 21, 2013

(30) Foreign Application Priority Data

Apr. 27, 2010 (ES) ..... 201030607

(51) Int. Cl.
*H05B 6/12* (2006.01)
*H05B 6/06* (2006.01)

(52) U.S. Cl.
CPC ..... *H05B 6/062* (2013.01)

(58) Field of Classification Search
CPC ..... H05B 6/062; H05B 6/22; H05B 13/06; H05B 6/1263
(Continued)

(56) References Cited

U.S. PATENT DOCUMENTS 5,648,008 A * 7/1997 Barritt et al. ..... 219/626
6,951,997 B2 * 10/2005 Larson et al. ..... 219/492
(Continued)

FOREIGN PATENT DOCUMENTS

CN 101500350 A 8/2009
DE 3610196 A1 * 10/1987
EP 1194011 B1 9/2008

OTHER PUBLICATIONS

International Search Report PCT/IB2011/051396.
(Continued)

*Primary Examiner* — Dana Ross
*Assistant Examiner* — Kuangyue Chen
(74) *Attorney, Agent, or Firm* — Michael E. Tschupp; Andre Pallapies; Brandon G. Braun

(57) ABSTRACT

A cooktop apparatus, in particular an induction cooktop apparatus, includes a switching unit configured to interrupt and establish current flow from a current supply, a first switching element receiving the current flow during an operating process, a control apparatus, which controls the
(Continued)

switching unit during the operating process such that the switching unit interrupts the current supply during a first time interval which has a duration of less than of half a period of the power supply voltage. The control apparatus causes the current supply to be connected during the operating process immediately before and immediately after the first time interval. The first switching element begins switching and ends switching during the first time interval.

17 Claims, 4 Drawing Sheets

(58) Field of Classification Search
USPC ..... 219/620, 621, 622, 650
See application file for complete search history.

(56) References Cited

U.S. PATENT DOCUMENTS

| | | | | |
|---|---|---|---|---|
| 7,355,152 | B2 * | 4/2008 | Liu et al. | 219/620 |
| 8,796,602 | B2 * | 8/2014 | Miyauchi et al. | 219/665 |
| 2004/0016747 | A1 | 1/2004 | Larson et al. | |
| 2006/0289489 | A1 * | 12/2006 | Wang | 219/622 |
| 2009/0321424 | A1 * | 12/2009 | Bunuel Magdalena et al. | 219/620 |
| 2011/0132899 | A1 * | 6/2011 | Shimomugi et al. | 219/620 |

OTHER PUBLICATIONS

National Search Report ES 201030607.
Report of Examination CN 2011800212813 dated Apr. 8, 2014.
Report of Examination CN 2011800212813 dated Oct. 11, 2014.

* cited by examiner

HOB DEVICE

BACKGROUND OF THE INVENTION

A cooktop with an inverter is known, by means of which inverter a power supply line can be interrupted and established, through which a current generated by means of a power supply voltage flows during an operating process and which leads to a switching element. The cooktop has a control apparatus, which controls the inverter during the operating process in such a manner that the inverter interrupts the power supply line during an entire time interval. The control apparatus also initiates the establishment of the power supply line immediately before and immediately after the time interval during the operating process. The control apparatus also initiates a switching of the switching element, which starts and ends during the time interval, and moves the switching element to a specified switching position. During a cooking process the switching element remains in the switching position, with current flowing through the switching element during the cooking process and the current serving to heat cookware inductively.

A cooktop with an inverter and two heating elements is also known, said two heating elements being supplied alternately with power by a single inverter during a single operating process. A switching position of an SPDT relay determines which of the two heating elements is supplied with power. A rectified AC voltage is present at the inverter. As the relay is switched, the rectified AC voltage is at a minimum.

BRIEF SUMMARY OF THE INVENTION

The object of the invention is in particular to provide a generic apparatus with improved attributes in respect of a high level of efficiency. According to the invention the object is achieved by the features of the invention, while advantageous embodiments and developments of the invention will emerge from the subclaims.

The invention is based on a cooktop apparatus, in particular an induction cooktop apparatus, having at least one switching unit, by means of which at least one power supply line can be interrupted and established, through which a current generated by means of a power supply voltage flows during at least one operating process and which leads to a first switching element, and having at least one control apparatus, which controls the switching unit during the operating process in such a manner that the switching unit interrupts the power supply line during at least one first entire time interval and which initiates the establishment of the power supply line immediately before and immediately after the first time interval during the operating process and which initiates a switching of the first switching element, which starts and ends during the first time interval.

It is proposed that the first time interval is shorter than the duration of half a period of the power supply voltage. A "switching unit" refers in particular to a unit which is provided to establish and interrupt an electrically conducting connection, the unit preferably having a transistor for this purpose. "Provided" means in particular specifically fitted and/or specifically designed and/or specifically programmed. A "power supply line" refers in particular to an electrically conducting connection. A "power supply voltage" refers in particular to a periodic voltage, at which power generated in a power plant, in particular for example a nuclear power plant or a coal-fired power plant, is output to the consuming household after being routed from the power plant to said consuming household by way of power lines, an effective value of the voltage preferably being 230 V and a frequency of the periodic voltage preferably being 50 Hz or 60 Hz. A "current generated by means of a power supply voltage" refers in particular to a current produced by an action of the power supply voltage, said current preferably being a rectified single-phase alternating current and particularly preferably having a frequency of 100 Hz or 120 Hz. The statement that the "switching unit interrupts the power supply line during an entire time interval" means in particular that the switching unit prevents the power supply line allowing the passage of electric current for the entire time interval. "Switching" of the switching element refers in particular to the cancellation of an electrically conducting connection, which features the switching element in at least one operating state, and/or the establishment of the electrically conducting connection. The statement that the switching "starts and ends during the time interval" means in particular, when switching consists of the cancellation of the electrically conducting connection, that the conducting connection of the switching element is initially present during the time interval and a state of the switching element changes during the time interval so that the conducting connection is completely interrupted at at least one time point of the time interval. The statement that the switching "starts and ends during the time interval" means in particular, when switching consists of the establishment of the electrically conducting connection, that the conducting connection of the switching element is initially completely interrupted during the time interval and a state of the switching element changes during the time interval so that the conducting connection is completely present at at least one time point of the time interval, whereby, in particular when two contacts of the switching element come into contact with one another during the establishment of the conducting connection, the action of coming into contact is completed before an end of the time interval. The statement that the switching "starts and ends during the time interval" means in particular, when switching consists of a cancellation of a first electrically conducting connection of the switching element and an establishment of a second electrically conducting connection of the switching element, that the first conducting connection of the switching element is initially present during the time interval and a state of the switching element changes during the time interval so that the first conducting connection is completely interrupted at at least one time point of the time interval and the second conducting connection of the switching element is initially completely interrupted during the time interval and a state of the switching element changes during the time interval so that the second conducting connection is completely present at at least one time point of the time interval, whereby, in particular when two contacts of the switching element come into contact with one another during the establishment of the second conducting connection, the action of coming into contact is completed before the end of the time interval. An inventive embodiment allows a high level of efficiency to be achieved. In particular an economical structure can be achieved together with a high level of heating efficiency. In particular an economical structure of the switching element and a long service life of the switching element can be achieved, combined with a supply of power during a single operating process to two different heating elements, each contributing to different cooking processes, by means of a single inverter. In particular the switching element can be switched in a preserving manner during the operating process, in that when a first electrically conducting connection is interrupted and a second electrically conducting connection is established by the switching element, no current flows through the connections. It is also possible in particular to achieve even loading of a power network over time.

It is also proposed that the cooktop apparatus should have at least one voltage supply unit, which applies a time-dependent voltage, which is at a minimum point essentially in the center of the first time interval, to the switching unit during the operating process. A "center" of the first time interval refers in particular to a time point at an equal time interval from the start and end of the time interval. A "minimum point" of the voltage refers in particular to a time point when the voltage is at a minimum. A "minimum" of the time-dependent voltage refers in particular to a voltage value of the voltage at a specified time point, which is within a time interval, in which the voltage only assumes values which are greater than or as great as the voltage value, the time point being different from a start point and an end point of the aforementioned time interval. The statement that the voltage is at a minimum point "essentially" in the center of the first time interval means in particular that the minimum point is at most 25 percent, preferably at most 10 percent and particularly preferably at most 2 percent of an overall duration of the time interval from the center. This allows operator-friendly use of the cooktop apparatus. In particular even loading of the power network can be achieved during operation of the cooktop apparatus.

The first time interval is preferably at least two milliseconds long. This reliably allows switching to take place in a preserving manner during the first time interval. In particular a switching process of the switching element can start and end reliably within the first time interval.

The first time interval is advantageously at least four milliseconds long. This reliably allows switching to take place in a preserving manner. It is in particular possible to compensate for deviations in a response time of the switching element from activation to the start of a switching process compared with a desired response time.

It is also proposed that during the operating process the control apparatus prompts the switching unit to interrupt the power supply line periodically in each instance for at least one entire time span, which is essentially as long as the first time interval. A time span which is "essentially" as long as the first time interval refers in particular to a time span, the length of which differs by at most forty percent, preferably by at most ten percent and particularly preferably by at most two percent from a length of the first time interval. This allows an efficient structure to be achieved. In particular a single inverter can direct current to both heating elements in an operating process, in which two different heating elements are operated to perform two different cooking processes.

It is also proposed that the cooktop apparatus has the first and at least one second switching element, which is connected in series with the first switching element, and the control apparatus switches the second switching element in a second time interval and the control apparatus interrupts the power supply line by means of the switching unit during the entire second time interval and the control apparatus uses the switching unit to initiate a flow of current through the power supply line immediately before and immediately after the second time interval. The statement that the control apparatus switches the second switching element "in a second time interval" means in particular that the control apparatus initiates a switching of the second switching element, which starts and ends during the second time interval. This allows the second switching element to have a long service life.

It is further proposed that in a first time segment, which immediately precedes the first time interval, the control apparatus switches the switching unit with a first set of switching parameters and in a second time segment, which immediately follows the first time interval, the control apparatus switches the switching unit with a second set of switching parameters, which is different from the first set of switching parameters. The statement that in a second time segment the control apparatus switches the switching unit with a second set of switching parameters, which is "different" from the first set of switching parameters, with which the control apparatus switches the switching unit in the first time segment, means in particular that a switching frequency of the switching unit is different in both time segments or, if the switching frequencies are identical, that the switching unit switches in a period in the first time segment for a certain fraction of the period and the switching unit is inactive in a period in the second time segment at the time of the fraction of the period. This allows a high level of flexibility to be achieved. In particular it allows a power output to different heating elements one after the other to be essentially identical, thereby in particular loading the power network evenly.

The switching unit preferably has at least two inverters, which are provided to influence a current flow through the first switching element. This allows a high level of flexibility to be achieved.

The first switching element is advantageously a relay, which has at least one coil. This allows an economical structure to be achieved.

It is further proposed that the switching unit should have at least one bipolar transistor with an isolated gate electrode. This allows efficient power control to be achieved.

A cooktop with a cooktop apparatus is also proposed, allowing a high level of efficiency to be achieved.

A cooktop control method is also proposed, in which a switching unit interrupts and establishes at least one power supply line to a first switching element, through which a current generated by means of a power supply voltage flows from time to time and a control apparatus controls the switching unit in such a manner that the switching unit interrupts the power supply line during at least one first entire time interval and the control apparatus initiates the establishment of the power supply line immediately before and immediately after the first time interval and the control apparatus initiates a switching of the first switching element, which starts and ends during the time interval, the first time interval being shorter than the duration of half a period of the power supply voltage. This allows a high level of efficiency to be achieved.

Further advantages will emerge from the description of the drawing which follows. The drawing shows an exemplary embodiment of the invention. The drawing, description and claims contain numerous features in combination. The person skilled in the art will also expediently consider the features individually and combine them in meaningful further combinations.

DETAILED DESCRIPTION OF EXEMPLARY EMBODIMENTS OF THE PRESENT INVENTION

Figure 1:
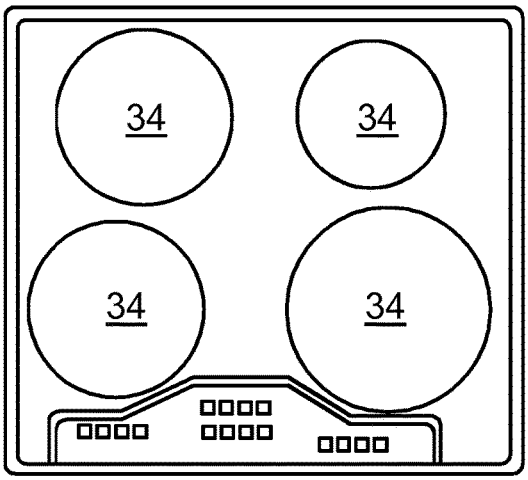
FIG. 1 shows a plan view of a cooktop having an inventive cooktop apparatus.
Figure 2A:
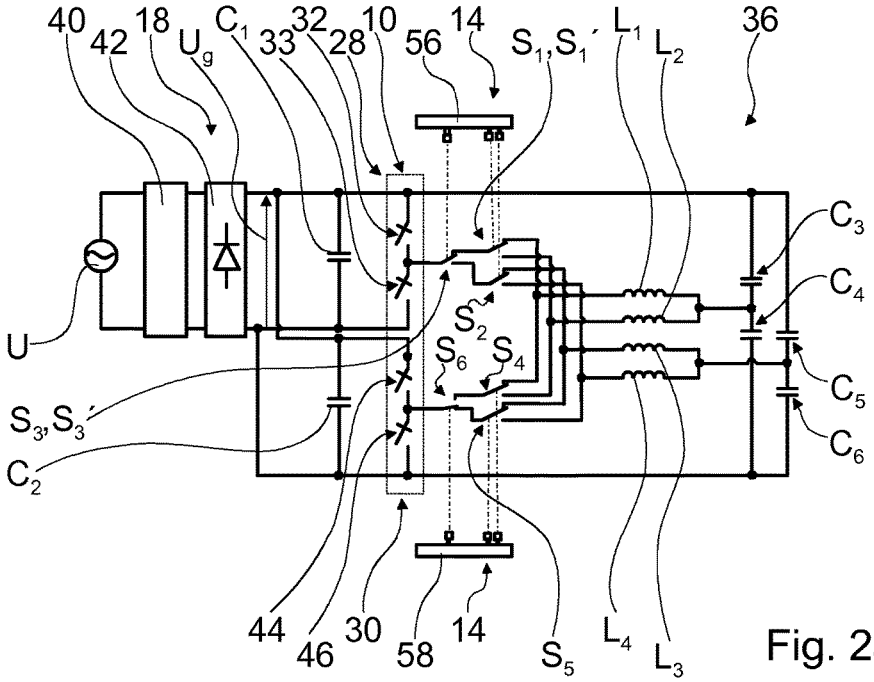
FIG. 2*a* shows a circuit of the cooktop apparatus in a first state.

FIG. 1 shows a plan view of a cooktop having an inventive cooktop apparatus configured as an induction cooktop apparatus, which has a number of cooking zones 34. A circuit 36 (FIG. 2*a*) of the cooktop apparatus has four heating elements $L_1$, $L_2$, $L_3$, $L_4$ configured as coils, which can all be operated at different power settings at the same time. One of the cooking zones 34 is assigned to each of the heating elements $L_1$, $L_2$, $L_3$, $L_4$ so that when the cooktop is in use, each heating element $L_1$ heats just one cookware element, for example a pot or pan. The circuit 36 has a switching unit 10, which is formed by a first and second inverter 28, 30. The first inverter 28 has a first bipolar transistor with an isolated gate electrode (the abbreviation "IGBT" is used for this in the following) 32 and a second IGBT 33. The inverter 30 also has a first IGBT 44 and a second IGBT 46.

The circuit 36 also has a regionally specific AC voltage source U, which supplies a power supply voltage with an effective value of 230 V and a frequency of 50 Hz. The cooktop apparatus described is intended in particular for operation in Europe. For cooktop apparatuses intended for operation in the US, a corresponding AC voltage source supplies a power supply voltage at 60 Hz. The voltage from the AC voltage source U first passes through a filter 40 in the circuit 36, which eliminates high-frequency noise and is essentially a low-pass filter. A voltage filtered by the filter 40 is rectified by a rectifier 42 in the circuit 36, which can be configured as a bridge rectifier, so that a rectified voltage $U_g$ (FIG. 3) is output at an output of the rectifier 42, being present between a collector of the IGBT 32 and an emitter of the IGBT 33. The rectified voltage is $U_g$ also present between a collector of the IGBT 44 and an emitter of the IGBT 46. The circuit 36 also has two capacitors $C_1$, $C_2$. A first contact of each of the capacitors $C_1$, $C_2$ is connected in a conducting manner to the collector of the IGBT 32 and in a conducting manner to a collector of the IGBT 44. A second contact of each of the capacitors $C_1$, $C_2$ is also connected in a conducting manner to the emitter of the IGBT 33 and in a conducting manner to the emitter of the IGBT 46. An emitter of the IGBT 32 is connected in a conducting manner to a collector of the IGBT 33. An emitter of the IGBT 44 is also connected in a conducting manner to a collector of the IGBT 46.

The circuit 36 also has a switching element $S_1$ configured as a relay $S_1'$ and five further relays $S_2$, $S_3$, $S_4$, $S_5$, $S_6$. The relays $S_1'$, $S_2$, $S_3$, $S_4$, $S_5$, $S_6$ are SPDT relays of identical structure. Each of the relays $S_1'$, $S_2$, $S_3$, $S_4$, $S_5$, $S_6$ has a first, second and third contact and a coil, the first contact being able to be connected as required to the second or third contact in a conducting manner by corresponding activation of the coil.

The first contact of the relay $S_3$ is connected in a conducting manner to the emitter of the IGBT 32. The second contact of the relay $S_3$ is also connected to the first contact of the relay $S_1'$. The third contact of the relay $S_3$ is connected in a conducting manner to the first contact of the relay $S_2$. The second contact of the relay $S_1'$ is connected in a conducting manner to a first contact of the heating element $L_1$. The third contact of the relay $S_1'$ is connected in a conducting manner to a first contact of the heating element $L_2$. The second contact of the relay $S_2$ is connected in a conducting manner to a first contact of the heating element $L_3$. The third contact of the relay $S_2$ is connected in a conducting manner to a first contact of the heating element $L_4$.

The first contact of the relay $S_6$ is also connected in a conducting manner to the emitter of the IGBT 44. The second contact of the relay $S_6$ is also connected to the first contact of the relay $S_4$. The third contact of the relay $S_6$ is connected in a conducting manner to the first contact of the relay $S_5$. The second contact of the relay $S_4$ is connected in a conducting manner to a first contact of the heating element $L_1$. The third contact of the relay $S_4$ is connected in a conducting manner to a first contact of the heating element $L_2$. The second contact of the relay $S_5$ is connected in a conducting manner to a first contact of the heating element $L_3$. The third contact of the relay $S_5$ is connected in a conducting manner to a first contact of the heating element $L_4$.

A second contact of the heating element $L_1$ is connected in a conducting manner to a second contact of the heating element $L_2$. A second contact of the heating element $L_3$ is also connected in a conducting manner to a second contact of the heating element $L_4$. The circuit 36 also has capacitors $C_3$, $C_4$, $C_5$, $C_6$. The second contact of the heating element $L_1$ is connected in a conducting manner to a first contact of the capacitor $C_3$ and to a first contact of the capacitor $C_4$. The second contact of the heating element $L_3$ is connected in a conducting manner to a first contact of the capacitor $C_5$ and to a first contact of the capacitor $C_6$. Second contacts of the capacitors $C_3$ and $C_5$ are connected in a conducting manner to the collector of the IGBT 32. Second contacts of the capacitors $C_4$ and $C_6$ are also connected in a conducting manner to the emitter of the IGBT 46.

A power supply line to the first switching means $S_1$, through which a current generated by means of the AC voltage source U flows during an operating process, can be established and interrupted both by means of the IGBT 32 and by means of the IGBT 33.

Figure 3:
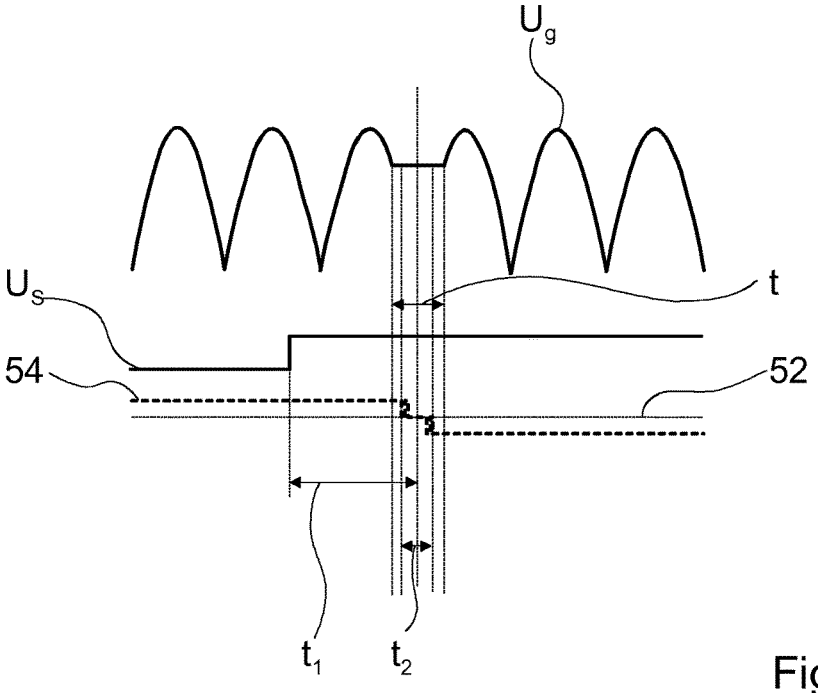
FIG. 3 shows a schematic diagram of a switching process, with time marked on the abscissa.

A control apparatus 14 of the circuit 36, which has two control units 56, 58, controls the switching unit 10 during the operating process, so that for each individual IGBT 32, 33, 44, 46 it is the case that a conducting connection between its collector and its emitter is interrupted during an entire time interval t (FIG. 3). To this end the control apparatus 14 is connected to the switching unit 10 and in particular to the gate terminals of the IGBTs 32, 33, 44, 46 (not shown). Immediately before and immediately after the time interval t at least one of the IGBTs 32, 33 and at least one of the IGBTs 44, 46 is in a state in which its collector is connected in a conducting manner to its emitter. In principle it is also conceivable for the control apparatus 14 only to initiate the interruption of a conducting connection between its collector and its emitter for each of the IGBTs 32, 33 during the entire time interval t, while the IGBTs 44, 46 can perform switching processes for example in the time interval t.

The relays $S_2$, $S_3$, $S_4$, $S_5$ and $S_6$ are initially in the following switching states during the operating process: in the case of the relays $S_2$, $S_3$, $S_4$, $S_5$ the first contact of each is connected in a conducting manner to the second contact.

In the case of the relay $S_6$ the first contact is connected in a conducting manner to the third contact.

FIG. 3 shows a schematic diagram of the bringing about of a switching process of the relay $S_1'$, with time shown on an abscissa 52. A switching position 54 of the relay $S_1'$, in other words a position of the first contact of the relay $S_1'$, is shown with a broken line. Before the time interval t the first relay $S_1'$ is in a first switching state, in which the first contact of the relay $S_1'$ forms a conducting connection to the second contact of the relay $S_1'$. During the time interval t there is no current flow through the conducting connection.

Figure 2B:
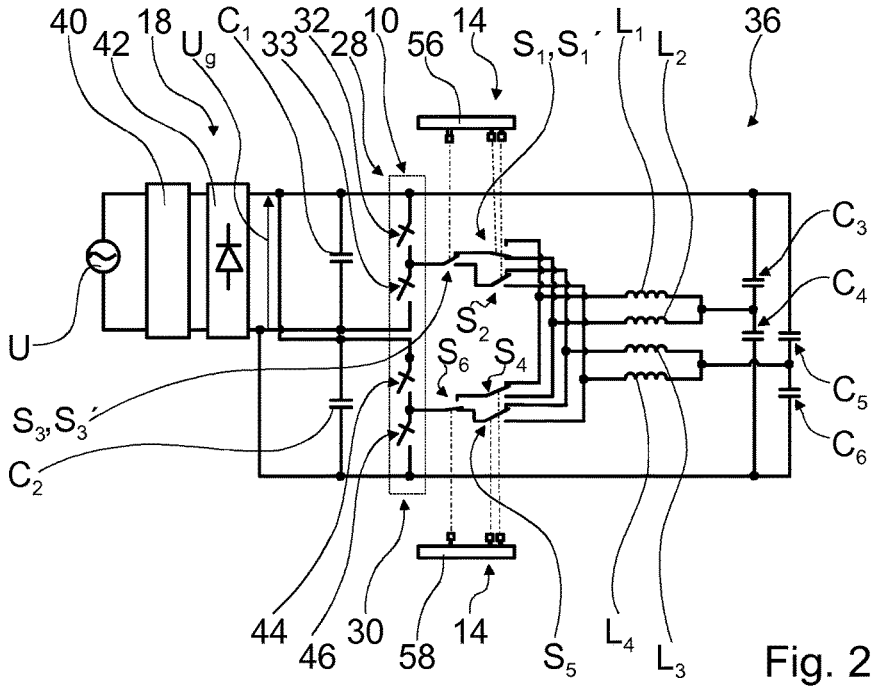
FIG. 2*b* shows the circuit of the cooktop apparatus in a second state.

During a time span $t_2$, which lies completely within the time interval t and which is some interval from the end points of the time interval t, the control apparatus 14 initiates the cancellation of the conducting connection starting from the first switching state (FIG. 2), in which process the first contact of the relay $S_1'$ is separated from the second contact of the relay $S_1'$ and then comes into contact with the third contact, after which the first and third contacts of the relay $S_1'$ form a conducting connection, said conducting connection being present before an end of the time interval t (FIG. 2*b*) and having no current flowing through it during the time interval t. To this end, at a time point, which is at a time interval $t_1$ from a center of the time span $t_2$, which characterizes a response time of the relay $S_1'$, the control apparatus 14 applies a voltage $U_S$ to the coil of the relay $S_1'$, causing a switching of the relay $S_1'$ in the time span $t_2$. The cancellation of the conducting connection between the first and second contacts of the relay $S_1'$ starts at a start time point of the time span $t_2$. Establishment of the conducting connection between the first and third contacts of the relay $S_1'$ ends at an end time point of the time span $t_2$. A deviation of a specific configuration of the relay $S_1'$ from a desired configuration means that the interval $t_1$ can deviate by a maximum deviation time. An overall duration of the time interval t is the sum of the time span $t_2$ and twice the total deviation time. Because the conducting connections of the relay $S_1'$ are without current during the time interval t, the switching process of the relay $S_1'$, which takes place during the time interval t, is particularly preserving for the relay $S_1'$, allowing the relay $S_1'$ to have a long service life. In principle it is conceivable during the time interval t for a further of the relays $S_2$, $S_3$, $S_4$, $S_5$, $S_6$, apart from the relay $S_1'$, to perform a switching process, which starts and ends during the time interval t.

The power supply voltage has a frequency of 50 Hz. The time interval t is smaller than the duration of half a period of the power supply voltage and has a length of eight milliseconds.

The AC voltage source U, the filter 40 and the rectifier 42 form a voltage supply unit 18, which applies the voltage $U_g$ to the switching unit 10 during the operating process. The voltage $U_g$ has a minimum point at the center of the time interval t. A voltage output by the AC voltage source U also has zero current at the center of the time interval t.

During the time interval t the capacitors $C_1$ and $C_2$ and the inactivity of the inverters 28, 30 ensure that the voltage $U_g$ is constant.

Figure 4:
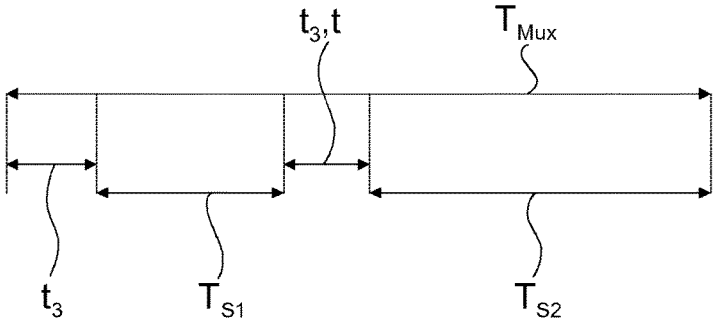
FIG. 4 shows a diagram of the duration of a period.

During the operating process the control apparatus 14 prompts the switching unit 10 to interrupt all the power supply lines, which can be established and interrupted by means of the switching unit 10, periodically for time spans $t_3$, which are as long as the time interval t. A period $T_{Mux}$ of the periodic interruption is shorter than one second (FIG. 4). The period $T_{Mux}$ starts with one of the time spans $t_3$, which is immediately followed by a first time segment $T_{S1}$. During the time span $t_3$ a switching process of the switching element $S_1$ starts and ends, switching the switching element $S_1$ from a state in which the first and third contacts of the switching element $S_1$ are connected in a conducting manner to a state in which the first and second contacts of the switching element $S_1$ are connected in a conducting manner. During the time segment $T_{S1}$ the control apparatus 14 prompts each individual IGBT 32, 33 to switch at a first frequency. The time segment $T_{S1}$ is immediately followed by one of the time spans $t_3$, which is identical to the time interval t. The time interval t is immediately followed by a time segment $T_{S2}$. During the time segment $T_{S2}$ the control apparatus 14 prompts each individual IGBT 32, 33 to switch at a second frequency, which is different from the first frequency. During the time segment $T_{S1}$ a power is output to the heating element $L_1$ by means of the first inverter 28 (FIG. 2*a*), said power corresponding roughly to the power output to the heating element $L_2$ (FIG. 2*b*) by means of the inverter 30 during the second time segment $T_{S2}$. This allows even loading of the power network. Lengths of the time segments $T_{S1}$, $T_{S2}$ are set by the control apparatus 14 according to the power settings, at which each individual heating element $L_1$, $L_2$ is to be operated, it being possible for the power settings of the heating elements $L_1$, $L_2$ to be different and for the heating elements $L_1$, $L_2$ to heat different cookware elements. During the time segments $T_{S1}$, $T_{S2}$ the inverter 30 supplies the heating element $L_3$ with power. In regions free of all time intervals $t_3$ the voltage $U_g$ is periodic with a period that is half as long as the period of the power supply voltage.

Figure 5:
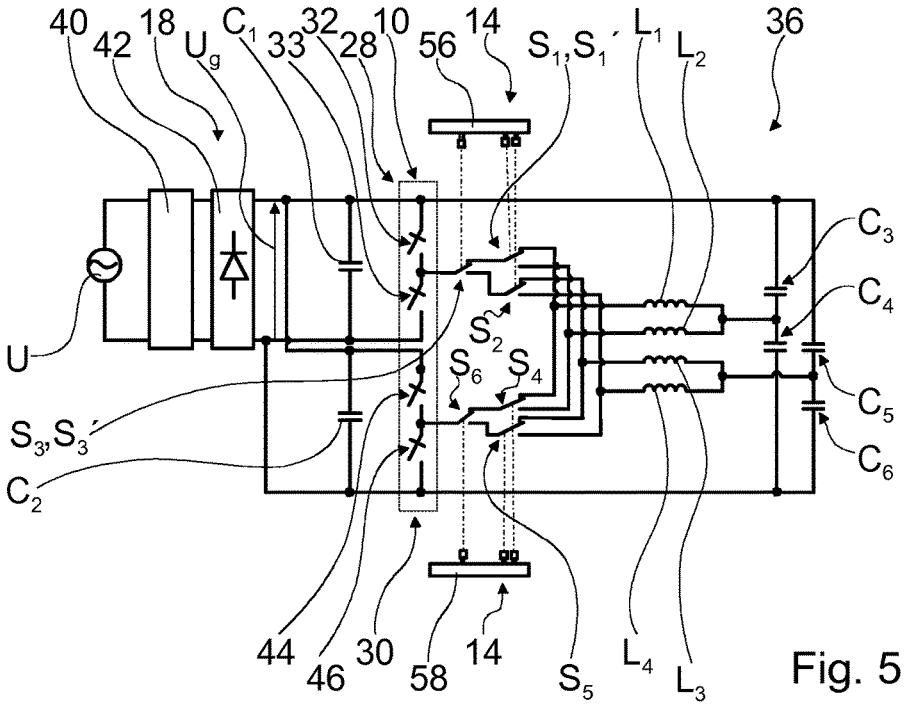
FIG. 5 shows the circuit in a third state.

The relay $S_3$ is a switching element $S_3'$, which is connected in series with the switching element $S_1$. In a further operating process, which is different from the operating process, the control apparatus 14 switches the relay $S_3$ in a second time interval, which is seven milliseconds long (FIG. 5). The switching of the relay $S_3$ starts and ends in the second time interval. The control apparatus 14 prompts each of the IGBTs 32, 33, 44, 46 to be in a blocking state, in other words without a conducting connection between its collector and its emitter, during the entire second time interval. Immediately before and immediately after the second time interval at least one of the IGBTs 32, 33 and at least one of the IGBTs 44, 46 switches. Immediately before and immediately after the second time interval all the IGBTs 32, 33, 44, 46 are switched periodically by the control apparatus 14.

In principle it is conceivable for the circuit 36 to have further relays and further heating elements, which are connected to the inverters 28, 30 by means of the further relays. In principle it is conceivable for the relays $S_1'$, $S_2$, $S_3$, $S_4$, $S_5$, $S_6$, which are configured as SPDT relays, each to be replaced with two SPST relays.

| Reference characters | |
|---|---|
| 10 | Switching unit |
| 14 | Control apparatus |
| 18 | Voltage supply unit |
| 28 | Inverter |
| 30 | Inverter |
| 32 | Bipolar transistor with isolated gate electrode |
| 33 | IGBT |
| 34 | Cooking zone |
| 36 | Circuit |
| 40 | Filter |
| 42 | Rectifier |
| 44 | IGBT |
| 46 | IGBT |
| 52 | Abscissa |
| 54 | Switching position |
| 56 | Control unit |

-continued

| Reference characters | |
|---|---|
| 58 | Control unit |
| U | AC voltage source |
| $U_g$ | Voltage |
| $U_s$ | Voltage |
| $C_1$ | Capacitor |
| $C_2$ | Capacitor |
| $C_3$ | Capacitor |
| $C_4$ | Capacitor |
| $C_5$ | Capacitor |
| $C_6$ | Capacitor |
| $S_1$ | Switching element |
| $S_1'$ | Relay |
| $S_2$ | Relay |
| $S_3$ | Relay |
| $S_3'$ | Switching element |
| $S_4$ | Relay |
| $S_5$ | Relay |
| $S_6$ | Relay |
| $L_1$ | Heating element |
| $L_2$ | Heating element |
| $L_3$ | Heating element |
| $L_4$ | Heating element |
| t | Time interval |
| $t_1$ | Interval |
| $t_2$ | Time span |
| $t_3$ | Time span |
| $T_{S1}$ | Time segment |
| $T_{S2}$ | Time segment |
| $T_{Mux}$ | Period |

The invention claimed is:

1. A cooktop apparatus, comprising:

a switching unit having a switching unit switch, the switching unit interpreting and establishing a current supply supplying a current generated from a mains voltage during an operating process, a first switch receiving the current, the first switch being separate from the switching unit switch, a controller which controls the switching unit during the operating process such that the switching unit interrupts the current during a first time interval which has a duration of less than half a period of the mains voltage, with the controller causing the current to be established during the operating process immediately before and immediately after the first time interval and causing the first switch to switch during the first time interval at a starting point and an end point, with the starting point and the end point located within the first time interval, wherein the first time interval has a duration of about eight milliseconds.

2. The cooktop apparatus of claim 1, wherein the cooktop apparatus is an induction cooktop apparatus.

3. The cooktop apparatus of claim 1, further comprising a voltage supply unit which applies during the operating process to the switching unit a time-dependent voltage having a minimum voltage located substantially at a midpoint of the first time interval.

4. The cooktop apparatus of claim 1, wherein during the operating process the controller causes the switching unit to interrupt the current periodically for a time span having a duration that is substantially identical to the duration of the first time interval.

5. The cooktop apparatus of claim 4, wherein the current is periodically interrupted for less than one second.

6. The cooktop apparatus of claim 1, further comprising a second switch connected in series with the first switch, wherein the controller switches the second switch in a second time interval, interrupts the current by the switching unit during the entire second time interval, and causes the switching unit to establish current flow through the current supply immediately before and immediately after the second time interval.

7. The cooktop apparatus of claim 1, wherein the controller switches the switching unit with a first set of switching parameters in a first time segment, which immediately precedes the first time interval, and switches the switching unit in a second time segment, which immediately follows the first time interval, with a second set of switching parameters being different from the first set of switching parameters.

8. The cooktop apparatus of claim 1, wherein the switching unit comprises at least two inverters, which are configured to affect current flow through the first switch.

9. The cooktop apparatus of claim 1, wherein the first switch is a relay having at least one coil.

10. The cooktop apparatus of claim 1, wherein the switching unit has at least one bipolar transistor with an isolated gate electrode.

11. A cooktop comprising a cooktop apparatus according to claim 1.

12. A method for controlling a cooktop apparatus, comprising the steps of:

interrupting and establishing with a switching unit having a switching unit switch a current supply supplying a current generated from a mains voltage during an operating process, receiving the current with a first switch, the first switch being separate from the switching unit switch, controlling the switching unit during the operating process with a controller such that the switching unit interrupts the current during a first time interval which has a duration of less than half a period of the mains voltage, establishing the current during the operating process immediately before and immediately after the first time interval, and causing the first switch to switch during the first time interval at a starting point and an end point, with the starting point and the end point located within the first time interval wherein the first time interval has a duration of about eight milliseconds.

13. The method of claim 12, and further applying to the switching unit with a voltage supply unit during the operating process a time-dependent voltage having a minimum voltage located substantially at a midpoint of the first time interval.

14. The method of claim 12, and further interrupting during the operating process with the switching unit the current periodically for a time span having a duration that is substantially identical to the duration of the first time interval.

15. The method of claim 14, wherein the current is periodically interrupted for less than one second.

16. The method of claim 12, and further switching a second switch connected in series with the first switch in a second time interval, interrupting the current during the entire second time interval, and causing the switching unit to establish current flow through the current supply immediately before and immediately after the second time interval.

17. The method of claim 12, and further switching the switching unit with a first set of switching parameters in a first time segment, which immediately precedes the first time interval, and switching the switching unit in a second time segment, which immediately follows the first time interval, with a second set of switching parameters being different from the first set of switching parameters.

* * * * *